US009718116B2

(12) United States Patent
Ring et al.

(10) Patent No.: US 9,718,116 B2
(45) Date of Patent: Aug. 1, 2017

(54) METHOD FOR THE PRODUCTION OF HOT-FINISHED SEAMLESS PIPES HAVING OPTIMIZED FATIGUE PROPERTIES IN THE WELDED STATE

(75) Inventors: Markus Ring, Haan-Gruiten (DE); Gerd Kloster, Mülheim/a.d. Ruhr (DE); Oliver Sommerkamp, Essen (DE); Caroline Rott, Düsseldorf (DE); Marion Erdelen-Peppler, Willich (DE)

(73) Assignee: VALLOUREC DEUTSCHLAND GMBH, Düsseldorf (DE)

( * ) Notice: Subject to any disclaimer, the term of this patent is extended or adjusted under 35 U.S.C. 154(b) by 1431 days.

(21) Appl. No.: 12/670,230

(22) PCT Filed: Jun. 26, 2008

(86) PCT No.: PCT/DE2008/001064

§ 371 (c)(1),
(2), (4) Date: May 17, 2010

(87) PCT Pub. No.: WO2009/012744

PCT Pub. Date: Jan. 29, 2009

(65) Prior Publication Data

US 2010/0326557 A1 Dec. 30, 2010

(30) Foreign Application Priority Data

Jul. 24, 2007 (DE) ..... 10 2007 034 895

(51) Int. Cl.
*B21J 5/08* (2006.01)
*B21K 21/12* (2006.01)

(52) U.S. Cl.
CPC ..... *B21J 5/08* (2013.01); *B21K 21/12* (2013.01)

(58) Field of Classification Search
CPC .... B21J 5/08; B21J 5/12; B21K 21/12; B21D 19/00; B21C 37/16; B21C 37/156; B21C 37/30

(Continued)

(56) References Cited

U.S. PATENT DOCUMENTS 4,375,160 A * 3/1983 Verdickt ..... B21B 17/04 72/208
4,579,087 A * 4/1986 Stol ..... F22B 37/104 122/235.12

(Continued)

FOREIGN PATENT DOCUMENTS

DE 37 42 496 A1 6/1988
DE 102004059091 A1 6/2006

(Continued)

OTHER PUBLICATIONS

"Stahlrohr Handbuch", 12th Edition, Vulkan-Verlag Essen, 1995, pp. 97-101.

*Primary Examiner* — Moshe Wilensky
*Assistant Examiner* — Mohammad Yusuf
(74) *Attorney, Agent, or Firm* — Henry M. Feiereisen LLC

(57) ABSTRACT

The invention relates to a method for the production of hot-finished, particularly hot-rolled, seamless pipes having optimized fatigue properties in the welded state, having an outside diameter of up to 711 mm and a nominal wall thickness of up to 100 mm, made of metal, in particular steel. After hot or finish rolling, a defined pipe cross-section is produced on at least one pipe end across a predetermined length, having tight tolerances for inside and outside diameters, wherein the cross-section can then be welded to the pipe end of another pipe. According to the invention, in a region a wall thickness is created in a first step at the pipe end in question, the thickness being bigger than on the remaining pipe body, wherein the outside diameter is increased and/or the inside diameter is reduced. In a second step, the required pipe cross-section is produced in said region by mechanical treatment, and the transition from the treated to the untreated region of the pipe is produced with low surface roughness and almost notch-free, and the (Continued)

residual wall thickness remaining in the treatment region is within the required tolerances.

9 Claims, 1 Drawing Sheet

(58) Field of Classification Search
USPC ..... 72/318, 370.03
See application file for complete search history.

(56) References Cited

U.S. PATENT DOCUMENTS

| | | | | |
|---|---|---|---|---|
| 4,845,972 | A * | 7/1989 | Takeuchi et al. | 72/370.03 |
| 5,184,495 | A * | 2/1993 | Chunn et al. | 72/318 |
| 5,379,625 | A | 1/1995 | Hale | |
| 5,517,843 | A * | 5/1996 | Winship | 72/318 |
| 5,743,301 | A | 4/1998 | Winship | |
| 7,169,480 | B2 * | 1/2007 | Matsubara et al. | 428/680 |
| 7,174,761 | B2 * | 2/2007 | Iwamoto et al. | 72/235 |
| 7,647,802 | B2 * | 1/2010 | Knirk | B21D 19/14 72/115 |
| 7,657,990 | B2 * | 2/2010 | Wodrich et al. | 29/527.4 |
| 2008/0184833 | A1 * | 8/2008 | Dohmann | 74/422 |
| 2008/0226396 | A1 * | 9/2008 | Garcia | C21D 9/08 405/195.1 |

FOREIGN PATENT DOCUMENTS

| | | | |
|---|---|---|---|
| GB | 1177017 | * | 1/1970 |
| WO | WO 93/10924 | A | 6/1993 |
| WO | WO 2005/031249 | A1 | 4/2005 |

* cited by examiner

METHOD FOR THE PRODUCTION OF HOT-FINISHED SEAMLESS PIPES HAVING OPTIMIZED FATIGUE PROPERTIES IN THE WELDED STATE

CROSS-REFERENCES TO RELATED APPLICATIONS

This application is the U.S. National Stage of International Application No. PCT/DE2008/001064, filed Jun. 26, 2008, which designated the United States and has been published as International Publication No. WO 2009/012744 and which claims the priority of German Patent Application, Serial No. 10 2007 034 895.0, filed Jul. 24, 2007, pursuant to 35 U.S.C. 119(a)-(d).

BACKGROUND OF THE INVENTION

The invention relates to a method for the production of hot-finished seamless pipes having optimized fatigue properties in the welded state. The invention also relates to a pipe produced with this method.

Different methods for producing seamless pipes are described, for example, in Stahlrohr Handbuch (Vulkan-Verlag, Essen, 12. Auflage 1995, S.97-101). (*Handbook of Steel Pipes*, published by Vulkan-Verlag, Essen, 12$^{th}$ edition 1995, page 97-101).

The pipes produced by this method find applications, for example, in the oil and gas extraction technology, wherein the individual pipe sections are butt-welded to form a continuous run.

A precise geometric match of the pipe ends to be welded with tight tolerances is required for forming the pipe connection so as to attain a high fatigue resistance of the weld connection during operation of the pipeline. To eliminate geometric notches, care needs to be exercised that the pipe ends to be welded together do not have offset edges.

The exact geometry and tight tolerances of the pipe ends to be welded together are important not only for meeting the strict requirements relating to fatigue resistance, but also for meeting the production costs of the weld connection.

The weld connection can be produced cost-effectively and efficiently, for example by automatic welding, only if the pipe ends to be welded together are exactly aligned with tight tolerances, which also ensures a high fatigue resistance of the weld connection. A substantially unimpeded flow of the medium through the pipeline is also guaranteed only under these circumstances.

Under realistic production conditions, the tolerances of hot-rolled seamless pipes cannot be maintained with the tight tolerances required for an efficient production of the connecting weld. In addition, small variations in the wall thickness and ovality in the pipe diameter can occur.

The ends of the pipes to be welded must be selected and matched to one another commensurate with their geometry. To date, such intentional matching has been possible only by taking actual measurements of the pipe ends.

WO 2005/031249 discloses an apparatus which measures the inside and outside geometry of pipe ends and thus makes it possible to intentionally select pipe ends with an exact match.

Disadvantageously, this process requires complicated logistics for storage and transport of the pipes to make sure that pipes with matching geometry are always on hand for a trouble-free manufacture. As another disadvantage, the production becomes inflexible during a malfunction, for example, if no pipe with matching geometry is available for a weld connection to a pipeline end.

SUMMARY OF THE INVENTION

It is therefore an object of the invention to provide a method for producing hot-rolled seamless pipes with pipe ends of uniform and exact geometry, which can be welded efficiently without requiring prior measurements and intentional matching of the pipe ends, and which at the same time provide a weld connection with high fatigue resistance.

According to the teaching of the invention, the object is solved by a method which is characterized in that in a first step, a greater wall thickness is produced in a region of the corresponding pipe end than in the remaining pipe body, wherein the outside diameter is increased and/or the inside diameter is decreased, and in a second step the desired pipe cross-section is produced in this region by mechanical treatment, and the transition from the treated to the untreated region of the pipe is produced continuously with little surface roughness and almost notch-free, and the residual wall thickness remaining in the treatment region is within the required tolerances.

With the method of the invention, the pipe ends can now advantageously be produced with a reproducible geometry which satisfies customer requirements and allows weld connections without requiring prior measurements and matching. The logistic complexity associated with storing and transporting the pipes is minimized, resulting in significant cost savings.

At the same time, very tight geometric tolerances are maintained at the pipe ends due to the mechanical treatment, resulting in optimal welding conditions and enabling an efficient production of the pipe connection, for example by automated welding methods. In addition, the almost complete absence of notches and the small surface roughness ensure a high fatigue resistance of the pipe connection.

A step-less connection in the longitudinal pipe direction from the thickened pipe end to the non-thickened pipe region advantageously provides for an unimpeded flow of the medium in the region where the pipe is subsequently connected. According to the invention, the radius or radii at the transition from the treated to the untreated pipe end are made as great as possible.

Advantageously, the wall thickness is increased until the measurement deviations due to the pipe tolerances, in particular with respect to roundness or ovality, can be almost entirely compensated by the subsequent mechanical treatment, without allowing the wall thickness to become smaller than a nominal wall thickness.

To ensure an adequate treatment margin, it has thus been proven beneficial to provide a wall thickening of at least 3 mm toward the outside of the pipe and/or toward the inside of the pipe along a length of at least 100 mm, starting from the end face of the pipe.

If necessary, the wall thickening can be greater or smaller and can also extend over shorter or longer sections.

On the other hand, to facilitate production and for cost reasons, the increase in the wall thickness and its longitudinal extent should be limited to the dimensions necessary for treatment.

The mechanical treatment of the wall thickening can be realized, for example, by turning, which can produce a very small ovality with very small diameter tolerances and very small surface roughness.

Advantageously, to ensure a qualitatively perfect weld of the pipe ends, a treatment length, beginning from the end face, of at least 100 mm has proven to be beneficial.

If necessary, a centering ring which projects into the treated regions of the two pipe ends can be inserted, before the pipe ends are welded together, to ensure optimal alignment of the pipe ends for automated welding.

According to the invention, the wall thickening is in a first advantageous variant of the method produced by upsetting, in particular by hot-upsetting of the pipe end.

The upsetting process is advantageously performed by offsetting the transitions to the pipe body produced during the upsetting operation on the outside and inside circumference along the longitudinal pipe axis. Extensive studies have shown that offsetting the transitions along the longitudinal pipe axis and positioning the radii in different cross-sectional planes of the pipe during mechanical treatment has a positive effect on the fatigue resistance of the connection under operating conditions.

Advantageously, these transitions are hereby provided with a greatest possible radius or combination of radii when the wall thickening is mechanically treated. As a result, a predetermined minimal wall thickness is reliably maintained because the transitions are located in different cross-sectional planes and thus provide a substantially continuous and notch-free transition to the non-thickened region of the pipe. This approach advantageously ensures a low stress concentration factor in the transition zone.

According to another advantageous embodiment of the invention, the wall thickening of the pipe end can also be realized using build-up welding or sinter-fusing, followed by mechanical treatment.

In the aforementioned variants of the method, generating the wall thickening is completely decoupled from the rolling process. This has the advantage that pipes, for example bearing pipes, which were originally not intended for the aforedescribed application, can be later provided with a wall thickening and a respective mechanical treatment.

Moreover, the thickening of the pipe ends can already be produced in conjunction with the production of the hot-rolled seamless pipe if this appears advantageous for production-related reasons. For example, an increased outside diameter can be produced by moving the rollers apart at the pipe end, while an decreased inside diameter can be produced by using a suitably constructed inside tool.

BRIEF DESCRIPTION OF THE DRAWING

Additional features, advantages and details of the invention are described in the following exemplary embodiments.

It is shown in.

DETAILED DESCRIPTION OF PREFERRED EMBODIMENTS

Figure 1:
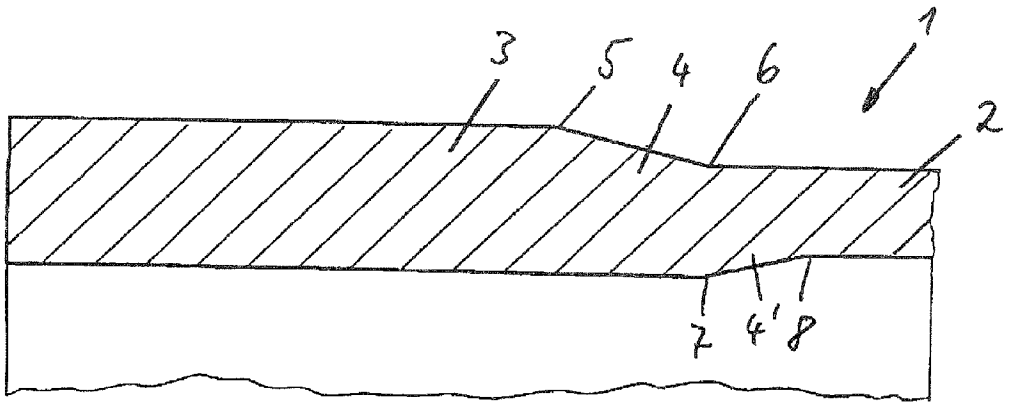
FIG. 1 a wall thickening at one pipe end produced by upsetting.

FIG. 1 shows in a longitudinal cross-section a segment of a pipe produced according to the invention with a wall thickening at the pipe end toward the outside and the inside of the pipe after upsetting.

The pipe 1 has in the end region a wall thickening 3 produced in a hot-forming step, which transitions in a transition region 4, 4' into the original cross-section 2 of the pipe 1.

In this example, the wall thickening 3 is implemented by increasing the outside diameter of the pipe 1 and reducing the inside diameter.

According to the invention, in the upsetting process, the transition region 4 produced on the outside circumference during upsetting and the transition region 4' produced on the inside circumference are offset with respect to the pipe body in the direction of the longitudinal pipe axis.

The transition region 4 produced by the upsetting process has shoulders 5 and 6 disposed on the outside circumference of the pipe 1, whereas the transition region 4' has shoulders 7 and 8 disposed on the inside circumference.

Figure 2:
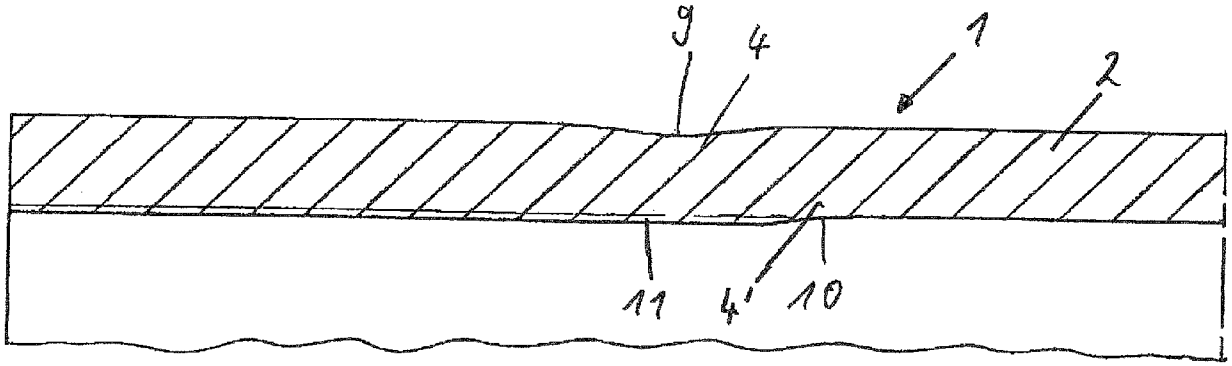
FIG. 2 a structure of a pipe end according to the invention in a treated state.

FIG. 2 shows the finished state of the end region of the pipe 1 produced by mechanical treatment.

The finished contour of the mechanically treated pipe 1 has in the originally thickened end region of the pipe 1 an outside diameter which corresponds to the original diameter of the pipe 1. The transition region 4 has a great radius 9 which almost completely eliminates notches due to a continuous step-free transition in conjunction with a very small surface roughness in the treated region.

In order to prevent the wall thickness of the pipe 1 from falling below a required minimum in the region of the transition region 4, the inside circumference of the thickened pipe end is not machined down to the original inside diameter, but there remains a slight wall thickening 11 from which the transition region 4' is also provided with a great radius 10, which transitions continuously and step-free into the original cross-section 2 of the pipe 1.

According to the invention, the radii 9 and 10 are located in different cross-sectional planes of the pipe, which has a positive effect on the fatigue resistance of the connection in the operating state.

With this arrangement, the wall thickness is never less than the required minimum wall thickness, and a substantially notch-free transition 4' to the original cross-section 2 of the pipe 1 can only be realized in this way.

What is claimed is:

1. A method for producing a hot-rolled, seamless pipe having optimized fatigue properties in the welded state, with an outside diameter of up to 711 mm and a nominal wall thickness of up to 100 mm, the pipe being made of steel, and having a pipe body with an inside diameter and an outside diameter and a pipe end, said method comprising the steps of:

providing the hot-rolled, seamless pipe;

increasing the outside diameter or decreasing the inside diameter, or both, of the hot-finished or hot-rolled pipe along a predetermined length of the pipe within predetermined tolerances to produce a region of the pipe end with a wall thickness greater than a wall thickness of the pipe body, the wall thickness being increased by at least 12 mm; and producing a desired pipe cross-section in the region with the greater wall thickness by mechanical machining so that a transition from the region of the pipe treated with the mechanical machining to a region of the pipe not treated with the mechanical machining is continuous and stepless with no surface roughness and is substantially notch-free, and wherein a residual wall thickness remaining in the treated region is within tolerances.

2. The method of claim 1, wherein the greater wall thickness of the pipe end region is produced by upsetting the pipe end, said upsetting being performed so as to result in respective transitions from the outside diameter and the inside diameter of the region with the greater wall thickness to the outside diameter and inside diameter of the pipe body, said respective transitions being offset relative to each other along a longitudinal extent of the pipe.

3. The method of claim 2, wherein the upsetting comprises a hot upsetting.

4. The method of claim 1, wherein the greater wall thickness of the pipe end region is produced by sinter-fusing.

5. The method of claim 1, wherein the greater wall thickness of the corresponding pipe end region is produced by build-up welding.

6. The method of claim 1, wherein the greater wall thickness is produced by hot-rolling before finish-rolling.

7. The method of claim 1, wherein the greater wall thickness extends, starting from an end face, over a length of at least 100 mm in a longitudinal pipe direction.

8. The method of claim 1, wherein an outside circumference or an inside circumference, or both, has a step-free transition in a longitudinal pipe direction from the pipe end with the greater wall thickness to a pipe region having a thickness that is not increased.

9. The method of claim 8, wherein the step-free transition has at least one corresponding radius on the outside diameter and at least one other corresponding radius on the inside diameter, with the at least one corresponding radius and the at least one other corresponding radius being located in different cross-sectional planes.

* * * * *